US010181647B2

(12) United States Patent
Werner et al.

(10) Patent No.: US 10,181,647 B2
(45) **Date of Patent: *Jan. 15, 2019**

(54) ANTENNA APPARATUS AND COMMUNICATION SYSTEM

(71) Applicant: The Penn State Research Foundation, University Park, PA (US)

(72) Inventors: Douglas H. Werner, State College, PA (US); Zhihao Jiang, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 160 days.

This patent is subject to a terminal disclaimer.

(21) Appl. No.: 15/353,119

(22) Filed: Nov. 16, 2016

(65) Prior Publication Data

US 2017/0069970 A1 Mar. 9, 2017

Related U.S. Application Data

(63) Continuation of application No. 14/747,350, filed on Jun. 23, 2015, now Pat. No. 9,531,075.

(Continued)

(51) Int. Cl.

| | |
|---|---|
| ***H01Q 9/04*** | (2006.01) |
| ***H01Q 1/27*** | (2006.01) |
| ***H01Q 1/38*** | (2006.01) |

(52) U.S. Cl.

CPC ..... *H01Q 9/045* (2013.01); *H01Q 1/273* (2013.01); *H01Q 1/38* (2013.01)

(58) Field of Classification Search

CPC ..... H01Q 1/38; H01Q 9/045; H01Q 1/273

See application file for complete search history.

(56) References Cited

U.S. PATENT DOCUMENTS

| | | | |
|---|---|---|---|
| 4,575,725 | A | 3/1986 | Tresselt |
| 4,587,524 | A | 5/1986 | Hall |

(Continued)

FOREIGN PATENT DOCUMENTS

| | | | |
|---|---|---|---|
| CA | 2170270 | C | 5/2000 |
| CA | 2659651 | A1 | 2/2008 |

(Continued)

OTHER PUBLICATIONS

"Wearable Textile Antenna in Substrate Integrated Waveguide Technology," R. Moro, S. Agneessens, H. Rogier, and M. Bozzi.

(Continued)

*Primary Examiner* — Dameon E Levi
*Assistant Examiner* — David Lotter
(74) *Attorney, Agent, or Firm* — Buchanan Ingersoll & Rooney PC

(57) ABSTRACT

An antenna apparatus can include a transmission medium that is positioned within layers of an antenna apparatus that are positioned adjacent to a first upper layer that is configured to include a signal receiving and transmission element (e.g. an antenna, patch antenna, etc.). The transmission medium can include or otherwise be connected to one or more resonators so that only a signal within a pre-selected band is passable through the transmission band. Any signal in a band outside of the pre-selected band may not be passable through the transmission medium due at least in part to the resonators. In some embodiments, the transmission medium may be part of a stripline or a microstrip. Embodiments of the apparatus may also be configured to block backward radiation emittable from the antenna to help prevent a body of a person near that device from absorbing such radiation.

19 Claims, 14 Drawing Sheets

Related U.S. Application Data

(60) Provisional application No. 62/032,113, filed on Aug. 1, 2014.

(56) References Cited

U.S. PATENT DOCUMENTS

| | | | | |
|---|---|---|---|---|
| 4,777,490 | A | 10/1988 | Sharma et al. | |
| 5,327,148 | A | 7/1994 | How et al. | |
| 5,777,583 | A | 7/1998 | Canora et al. | |
| 6,011,524 | A | 1/2000 | Jervis | |
| 6,061,025 | A | 5/2000 | Jackson et al. | |
| 6,148,221 | A * | 11/2000 | Ishikawa | H01L 39/128 257/E39.011 |
| 6,466,171 | B1 | 10/2002 | Sherman et al. | |
| 6,563,468 | B2 | 5/2003 | Hill et al. | |
| 7,307,590 | B1 | 12/2007 | Tonn | |
| 7,429,952 | B2 | 9/2008 | Sun | |
| 7,626,549 | B2 | 12/2009 | Channabasappa | |
| 8,648,766 | B2 | 2/2014 | Johnston et al. | |
| 8,681,068 | B1 | 3/2014 | Williams et al. | |
| 2002/0008665 | A1 * | 1/2002 | Takenoshita | H01P 3/121 343/700 MS |
| 2002/0047804 | A1 | 4/2002 | Ghosh | |
| 2002/0163468 | A1 * | 11/2002 | Anderson | H01Q 9/0428 343/700 MS |
| 2006/0109192 | A1 | 5/2006 | Weigand | |
| 2006/0262023 | A1 | 11/2006 | Engargiola et al. | |
| 2010/0079663 | A1 | 4/2010 | Kim | |
| 2010/0100157 | A1 | 4/2010 | Nghiem et al. | |
| 2011/0248890 | A1 | 10/2011 | Lee et al. | |
| 2011/0309893 | A1 | 12/2011 | Kawamura et al. | |
| 2013/0293441 | A1 | 11/2013 | Zhang | |
| 2013/0342409 | A1 | 12/2013 | Tatamikov et al. | |
| 2015/0054696 | A1 | 2/2015 | Werner et al. | |

FOREIGN PATENT DOCUMENTS

| | | | |
|---|---|---|---|
| EP | 0449492 | B1 | 2/1995 |
| WO | 1995006336 | A1 | 3/1995 |
| WO | 2005065289 | A2 | 7/2005 |
| WO | 2008019748 | A1 | 2/2008 |
| WO | 2010079663 | A1 | 7/2010 |
| WO | 2012110098 | A1 | 8/2012 |

OTHER PUBLICATIONS

"Dual-Band Wearable Textile Antenna on an EBG Substrate," Shaozhen Zhu and Richard Langley, IEEE Transactions on Antennas and Propagation, vol. 57, No. 4, Apr. 2009.

"A Compact, Low-Profile Metasurface-Enabled Antenna for Wearable Medical Body-Area Network Devices," Zhi Hao Jiang, Donovan E. Brocker, Peter E. Sieber, Douglas H. Werner, IEEE Transactions on Antennas and Propagation, vol. 62, No. 8, Apr. 2014.

International Search Report and Written Opinion for PCT/US2015/037337 dated Oct. 22, 2015.

Written Opinion of the International Searching Authority for PCT/US2015/037337 dated Oct. 22, 2015.

* cited by examiner

ANTENNA APPARATUS AND COMMUNICATION SYSTEM

CROSS-REFERENCE TO RELATED APPLICATIONS

The present application is a continuation application of U.S. patent application Ser. No. 14/747,350, which claims priority to U.S. Provisional Patent Application No. 62/032,113, which was filed on Aug. 1, 2014.

STATEMENT REGARDING FEDERALLY SPONSORED RESEARCH

This invention was made with government support under Grant No. EEC1160483, awarded by the National Science Foundation. The Government has certain rights in the invention.

FIELD OF INVENTION

The present invention relates to antennas and communication systems that may utilize one or more such antennas for facilitating communication between different electronic devices such as sensors, body monitoring devices, measuring devices, computers, or other communication devices. For example, in one exemplary embodiment a communication device may be configured to be worn by a person for battle field survival, body monitoring, or wearable computing and may include one or more embodiments of the antenna to permit the device to form radio frequency links with other devices.

BACKGROUND OF THE INVENTION

Attempts have been made to try and use different types of antennas for wearable applications, such as a 2.4 GHz industrial, scientific, and medical (ISM) band antenna that includes a planar monopole/dipole antenna, an inverted-F antenna, a slot antenna, and a slot antenna with artificial magnetic conducting surface backing. But, such antenna designs have deficiencies that prevent them from being feasible options for such systems. For example, the monopole/dipole antennas direct a large amount of energy that is radiated to a human body, which generates an undesirable high specific absorption rate in the tissue of the human body. The inverted-F antenna and slot antenna designs also have most of the energy radiated toward a particular top half space. These antennas' form-factors are still not compact enough for feasible or practical application with wearable medical devices that can be suitable for being worn by humans or other living animals. Additionally, the inverted-F antenna and slot antennas suffer from low front-to-back ratio and low antenna efficiency. Such antennas often also have linear polarization, which can make them sensitive to human body movement and prevent them from reliably supporting wireless links. Additionally, these antennas can have spurious bands overlapping with other wireless communication systems that can cause interference as well as the potential for insecure data transfer.

SUMMARY OF THE INVENTION

An antenna apparatus for a communication device is provided. The communication device may be an electronic device such as a smart phone, a sensor, a detector, a measurement device, an electronic tablet or other type of electronic device. In some embodiments, the antenna apparatus can include a first layer having an antenna or other type of signal receiving and transmitting element and at least one stripline attached to the first layer. In other embodiments, the apparatus may include a first layer having an antenna or other type of signal receiving and transmitting element and a microstrip or one or more other types of planar transmission line circuits attached to that first layer.

In some embodiments, the antenna apparatus can include a first layer having an antenna and a first stripline attached to the first layer. The first stripline can be comprised of a second layer, a third layer, and a fourth layer. The third layer may be positioned between the second and fourth layers. A transmission medium can be within the third layer and resonators can be connected to that transmission medium so that only a signal received by the antenna within a pre-selected band is passable through the transmission medium and any signal having a band outside of the pre-selected band is stopped by the resonators so that the signal is not passable through the transmission medium.

In some embodiments, the first layer, second layer and third layer can each include a metallic layer and a dielectric substrate layer. The fourth layer can include a metallic layer. For the third layer, the metallic layer may be entirely enclosed by the dielectric substrate of the third layer and/or the dielectric layer of the second layer. In some embodiments, the metallic layers of the second and fourth layers can be comprised of copper or be configured as a copper sheet or be comprised of another type of metal. The metallic layer of the first layer may be configured as an antenna and the metallic layer of the third layer can be configured as a transmission medium. In some embodiments, the stripline can also be configured to block radiation to be emitted by the antenna. In some embodiments, the metallic layers may be alternatively composed of another type of conductive material (e.g. graphene, a conductive polymeric material, etc.).

For some embodiments, the transmission medium can be comprised of resonators connected to the transmission medium such that only a signal within a pre-selected band is passable through the transmission medium and any band outside of the pre-selected band is stopped by the transmission medium. The pre-selected band may be any of a number of different bands, such as, for example, a 2.4-2.48 GHz band or a 3.75-4.25 GHz band.

In some embodiments, the stripline can be configured so that an output impedance of the stripline is to be about complex conjugate (e.g. within 2% or within 5%-10% of being complex conjugate) with an input impedance of the antenna of the first layer. In other embodiments, the stripline is configured so that an output impedance of the stripline is complex conjugate with an input impedance of the antenna of the first layer.

Some embodiments of the antenna apparatus can be configured so that at least one via extends from the second layer to the first layer and at least one via extends from the third layer to the second layer. For instance, at least one via may extend from a metallic layer of the first layer to a metallic layer of the second layer and at least one via may extend from the metallic layer of the third layer to the metallic layer of the second layer. For some embodiments, the stripline can also be configured to block backward radiation being emitted from the antenna.

In some embodiments, the first layer is comprised of a substrate and an antenna within the substrate of the first layer. A radiation pattern of the antenna can be configured to have a peak that points in a broadside direction.

In some embodiments of the antenna apparatus, the stripline can be configured so that an output impedance of the stripline is complex conjugate with an input impedance of the antenna of the first layer. The stripline can be comprised of resonators that are configured to define stop bands to prevent transmission of a signal to or through the stripline that is outside of the pre-selected band range. In some embodiments, the stripline can be comprised of a circuit having open loop resonators, and/or a plurality of planar microwave resonators, and/or a plurality of microwave resonators.

In some embodiments, the stripline can include multiple transmission mediums, or there may be multiple striplines within the antenna. For example, in some embodiments, the stripline structure can be configured to include a first microwave filtering circuit and a second microwave filtering circuit that has a 90° phase shift from the first microwave filtering circuit.

As another example, embodiments of the antenna apparatus can be configured to include a first stripline and a second stripline, and a 90° phase shifter that connects the first stripline to the second stripline. The first stripline can be comprised of a first transmission medium connected to the phase shifter and the second stripline can be comprised of a second transmission medium connected to the phase shifter, the first transmission medium having resonators and the second transmission medium having resonators. The first and second striplines can be within a substrate that is positioned between an upper ground plane and a lower ground plane. The first and second striplines can be positioned so that they are enclosed within the substrate such that the substrate separates the first and second striplines from the upper and lower ground planes. The antenna can also be attached to the upper ground plane to ground the antenna.

In other embodiments, the antenna apparatus may not include any striplines. Instead, the antenna apparatus may be configured to include a first layer having an antenna and at least one microstrip attached to the first layer.

In yet other embodiments of the antenna apparatus, the antenna apparatus can include a first upper layer, a second layer, and a third layer. The first upper layer can include a first conductive material layer that is posited on or in a first dielectric substrate layer. The first conductive material layer can be configured as a signal receiving and transmitting element (e.g. an antenna, etc.). The second layer can have a second conductive material layer and a second dielectric substrate layer, the second conductive material layer can be positioned between the first and second dielectric substrate layers. The third layer can have a third conductive material layer and a third dielectric substrate layer. The third conductive material layer can be located between the second and third dielectric substrate layers. A transmission medium can be positioned in or defined in the third conductive material layer. At least one resonator can be connected to the transmission medium so that only a signal within a pre-selected band is passable through the transmission medium and any band outside of the pre-selected band is stopped by the at least one resonator such that the signal is not passable through the transmission medium. At least one first via can extend from the first conductive material layer to the second conductive material layer and at least one second via can extend from the second conductive material layer to the third conductive material layer to conductively connect the first conductive layer to the transmission medium.

The one or more resonators may be configured so that an output impedance of the transmission medium is to be about complex conjugate (e.g. within 2% or within 5%-10% of being complex conjugate) with an input impedance of the signal receiving and transmitting element of the first layer. In other embodiments, the one or more resonators can be configured so that an output impedance of the transmission medium is complex conjugate with an input impedance of the signal receiving and transmitting element of the first layer. In some embodiments, the one or more resonators may be configured so that the pre-selected band is the 2.4-2.48 GHz band, the 3.75-4.25 GHz band, or another type of wireless transmission band or radio transmission band.

For some embodiments of the antenna apparatus having the first, second and third layers, there may also be a fourth conductive material layer positioned below the third dielectric layer such that the third dielectric layer is between the third and fourth conductive material layers. The second conductive material layer can be configured to define an upper ground plane and the fourth conductive material layer can define a bottom ground plane or a lower ground plane. The antenna apparatus can also be configured so that a peak of a radiation pattern for radiation emitted from the signal receiving and transmitting element points in a forward direction away from the first, second, third, and fourth layers and backwardly directed radiation from the signal receiving and transmitting element that is to be emitted in a direction toward the second and third layers is blocked by the second layer, third layer, and fourth conductive material layer.

A communication system is also provided. The communication system can include a communication device that communicates with one or more electronic devices. At least one of those electronic devices can have an embodiment of our antenna apparatus. The communication device may be a desktop computer, an electronic tablet, a remote server computer device, a base station, a router, or other type of communication device. The electronic device may be configured as a sensor, a wearable sensor, a detector, a measuring unit, or other type of electronic device that is configured to wirelessly communicate data between the electronic device and the communication device via the antenna apparatus. The communication device and electronic device may be configured to establish a wireless communication link with the electronic device via the antenna apparatus.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of our antenna apparatus, systems that utilize one or more embodiments of our antenna apparatus, and methods of making and using the same are shown in the accompanying drawings. It should be appreciated that like reference numbers used in the drawings may identify like components.

DETAILED DESCRIPTION OF EXEMPLARY EMBODIMENTS

Figure 1A:
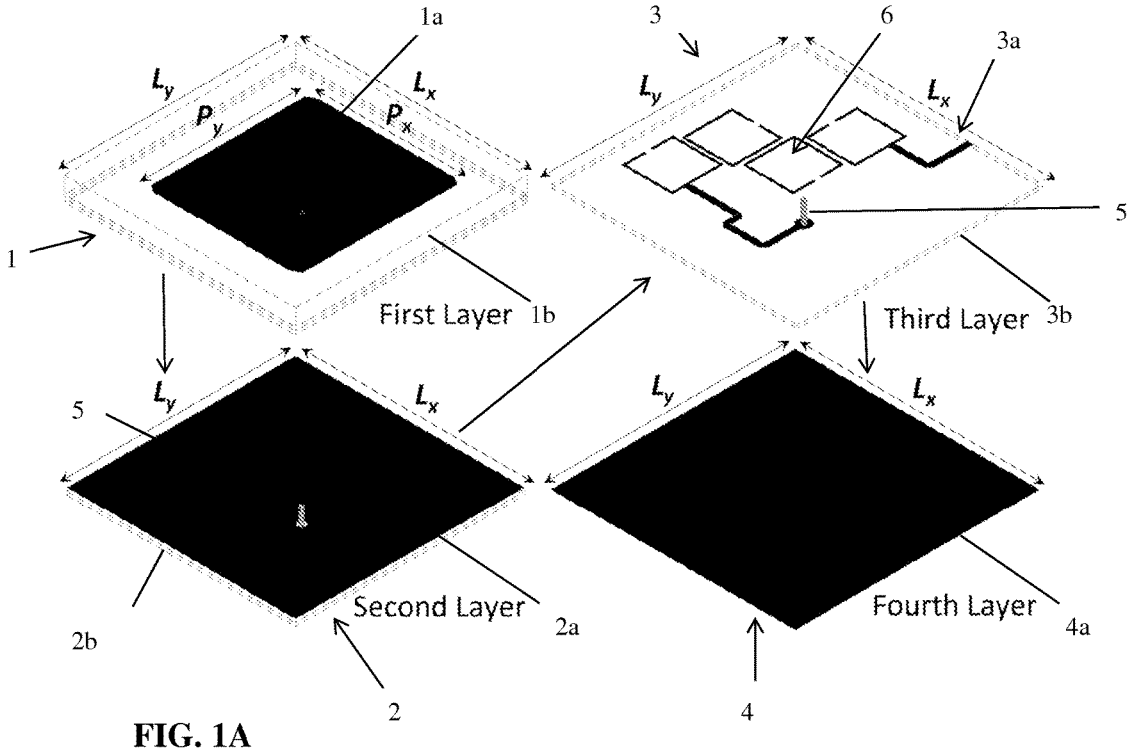
FIG. 1A is an exploded view of a first exemplary embodiment of the antenna apparatus in which black colored portions represent printed metal layers (e.g. copper, etc.) while white color portions represent dielectric substrates. Elements 5 represent metallic vias.

We have determined that embodiments of our antenna apparatus can be configured to have a relatively low-profile design that can provide for a circular-polarized integrated filtering antenna to have high out of band rejection for both narrowband and wideband systems such that the embodiments of the antenna can include associated microwave filtering circuits as an integrated device for the antenna. Some embodiments of the antenna apparatus can be configured so that the antenna or other type of signal receiving and transmitting element of that antenna apparatus is configured for a complex impedance load or is configured as a last stage of a filtering circuit to allow for a relatively clean spectrum so that a signal can only be received and/or transmitted within a targeted band (e.g. the pass band of the filtering antenna can have a very sharp roll off). Embodiments of the antenna apparatus can also be configured to enable bandwidth broadening while maintaining a low profile. We have determined that embodiments of our antenna apparatus can reduce interference between different systems and also increase the security of a data transfer between the antenna apparatus and one or more other devices to which the antenna apparatus is communicating over a wireless link, radio link, or other type of wireless connection.

Referring to FIGS. 1A-6, a first exemplary embodiment of our antenna apparatus 9 can include a plurality of layers such as a first layer that includes a first layer 1 having a first upper metallic layer 1*a* and a first lower dielectric layer 1*b*, a second layer 2 having a second metallic layer 2*a* and a second lower dielectric layer 2*b*, a third layer 3 having a third metallic layer 3*a* and a third dielectric layer 3*b*, and a fourth layer 4 having a fourth metallic layer 4*a*. The first metallic layer 1*a* can be a top layer and the fourth metallic layer 4 can be a bottom layer of the antenna. It should be appreciated that the metal of the first, second, third, and fourth metallic layers 1*a*, 2*a*, 3*a*, and 4*a* can be a conductive material. The metal compositions for each of the metallic layers may be unique to that layer or may be the same type of metal as in at least one other metallic layer. In yet other embodiments, all of the metallic layers may be composed of the same type of metal.

In some alternative embodiments, at least one of the metallic layers, such as at least one of the first upper metallic layer 1*a*, second metallic layer 2*a*, third metallic layer 3*a*, and fourth metallic layer 4*a*, can be composed of a non-metal type of conductive material such as graphene or a conductive polymeric material. In yet other alternative embodiments, all of the metallic layers may be alternatively composed of the same non-metal type of conductive material or other type of conductive material.

The first lower dielectric layer 1*b* can be positioned between the first metallic layer 1*a* and the second metallic layer 2*a* and be bonded or otherwise attached to each of these metallic layers. The second dielectric layer 2*b* can be positioned between the second and third metallic layers 2*a* and 3*a* and be bonded or otherwise attached to each of these metallic layers. The third dielectric layer 3*b* can be positioned between the third and fourth metallic layers 3*a* and 4. Each dielectric layer can be comprised of an insulating material. At least one via 5 can extend from the second metallic layer 2*a* to the first metallic layer 1*a* to connect these layers. At least one via 5 can also extend form the third metallic layer 3*a* to a respective via 5 of the second metallic layer 2*a* to connect these layers together so that a signal can be fed from the antenna (e.g. a signal receiving and transmitting element) of the first layer to the stripline of the third metallic layer 3*a*. The third metallic layer 3*a* may be bonded or otherwise attached to the fourth metallic layer 4*a* via the third dielectric layer 3*b* positioned between the third and fourth metallic layers 3*a* and 4. Each layer can have a length ($L_x$), a width ($L_y$) and a thickness, or height. The antenna of the first metallic layer 1*a* can be planar in shape and have a length $P_x$ and a width $P_y$. The planar patch antenna of the first metallic layer 1*a* can have any of a number of shapes, such as a square, rectangular, circular, elliptical, or other geometric shape. In some alternative embodiments, the fourth layer 4 can be omitted when a microstrip structure is utilized for the third layer 3 instead of a stripline structure.

The first metallic layer 1*a* can be configured as a top patch antenna that is fed by a via and a stripline coupled resonator microwave band pass filter that includes a transmission medium 6 of a stripline located in (e.g. positioned in or defined in) the third metallic layer 3*a* along the diagonal line of the patch to obtain in-band circular polarization. In some embodiments, the transmission medium 6 may be a transverse electromagnetic transmission line medium that is fully positioned within the dielectric layer 3*b* of the third layer 3*a*. The second layer 2 can be a metal sheet or include a metal sheet that functions as a top ground plane of the stripline and also as the ground plane for the first layer 1. The fourth metallic layer 4*a* can be a metal sheet or can include a metal sheet that is configured to function as a bottom ground plane for the stripline. The stripline integrated into the first exemplary embodiment of the antenna apparatus can be defined by the second, third, and fourth layers 2, 3, and 4 of the antenna apparatus and the transmission medium 6 of the third layer 3 while the signal receiving and transmitting element of the antenna apparatus can be defined as the antenna of the first layer 1 of the antenna apparatus.

The transmission medium 6 can be a circuit that includes resonators and a metal transmission medium that is entirely within insulating material of a dielectric substrate that defines the third layer 3 or can be entirely within the material of the second and third dielectric layers 2*b* and 3*b* (e.g. the resonators are included in the transmission medium or otherwise connected to it). Vias can also be included in the bandpass filter circuit of the third metallic layer that are connected between the third metallic layer 3*a* and the second and fourth metallic layers 2*a* and 4*a*. The width, thickness, and relative permittivity of the third dielectric layer 3*b* and/or second dielectric layer 2*b* can help define the characteristic impedance of the transmission medium 6. The second and fourth metallic layers 2*a* and 4*a* may be spaced apart from the transmission medium 6 by a portion of the second and third dielectric layers 2*b* and 3*b* that is between the transmission medium 6 and the second or fourth metallic layer 2*a* or 4*a*. Vias can connect the second and fourth metallic layers 2*a* and 4*a* together in some embodiments of the antenna apparatus to short the upper ground plane of the second layer 2 to the bottom ground plane of the fourth layer 4.

Figure 1B:
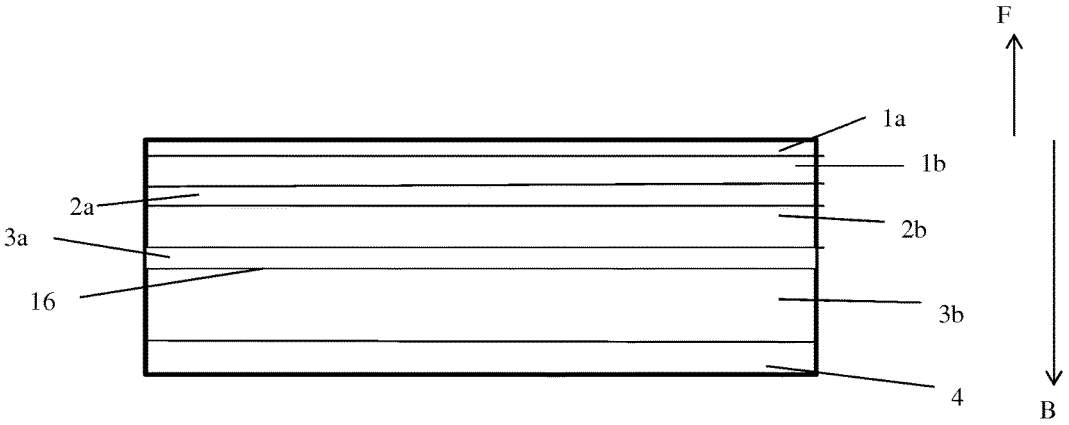
FIG. 1B is a side view of the first exemplary embodiment of the antenna apparatus.

The stripline of the first exemplary embodiment of the antenna apparatus can be configured to provide blockage to radiation that may be directed backwardly (e.g. in a backward direction B as shown in FIG. 1B, which is a direction that extends away from the top layer and toward the fourth layer and is a direction that is opposite a forward direction F that is a direction that extends away from the first, second, third, and fourth layers). The stripline can be configured so that input impedance of the patch antenna of the top layer 1 and the output impedance of the filter of the stripline are almost complex conjugate such that a pass band in a targeted band and stop bands elsewhere can be formed. It should be understood that the stop bands can prevent passage of a signal received by the antenna while the pass band can permit a signal received by the antenna of the upper first layer 1 to pass through. Open loop resonators can be utilized in the transmission medium 6 of the stripline to function as filtering elements. Other embodiments can utilize other types of resonators. For example, other types of planar microwave resonators may be utilized in other embodiments to achieve a desired pass band and stop band configuration.

The first exemplary embodiment of the antenna apparatus can be configured to operate in the 2.4-2.48 GHz band. Other embodiments of the antenna apparatus can be configured to operate in one or more other bands. For instance, other embodiments may be configured to operate in a pre-selected band that is not within the 2.4-2.48 GHz band.

A prototype of the first exemplary embodiment of the antenna apparatus was fabricated that had dimensions that were designed by time domain tuning and subsequent optimization using a covariance matrix adaptation evolution strategy (CMA-ES) to operate in a pre-selected band, which is the 2.4-2.48 GHz band for the first exemplary embodiment. The metal for the metallic layers used in this prototype was copper. The prototype of the first exemplary embodiment of the antenna apparatus had a form factor of 55 mm by 55 mm by 5 mm, i.e. $0.45\lambda_0$, by $0.45\lambda_0$ by $0.04\lambda_0$ and was configured to operate in the 2.4-2.48 GHz band. Both measured results and simulated results of the prototype of the first exemplary embodiment were created and/or collected.

Figure 2A:
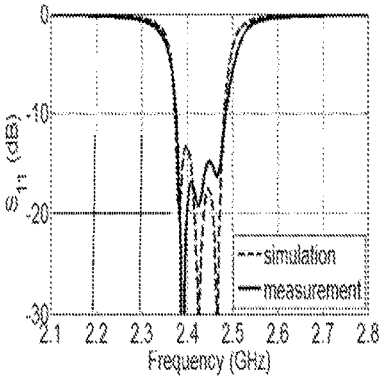
FIG. 2A is a graph illustrating simulated and measured return loss ("$S_{11}$") results for a fabricated prototype of the first exemplary embodiment of the antenna apparatus.
Figure 2B:
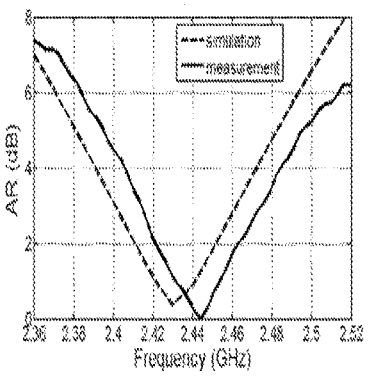
FIG. 2B is a graph illustrating simulated and measured results for axial ratio for a fabricated prototype of the first exemplary embodiment of the antenna apparatus.
Figure 2C:
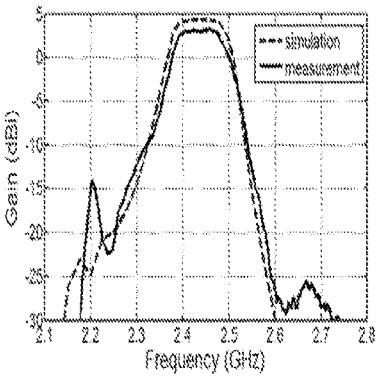
FIG. 2C is a graph illustrating simulated and measured antenna gain for a fabricated prototype of the first exemplary embodiment of the antenna apparatus.
Figure 3A:
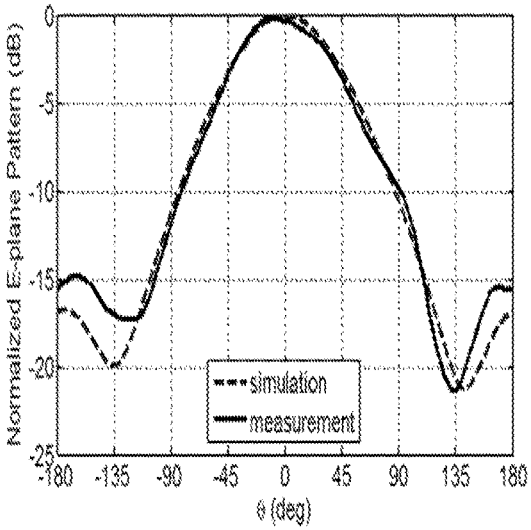
FIG. 3A is a graph illustrating simulated and measured normalized radiation patterns in the E-plane at 2.44 GHz for the fabricated prototype of first exemplary embodiment of the antenna apparatus.
Figure 3B:
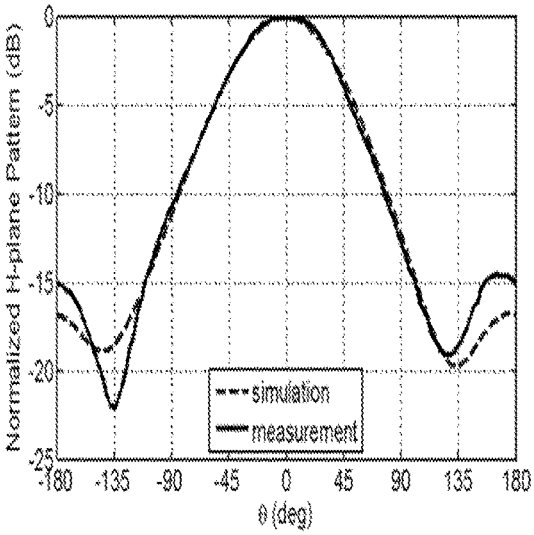
FIG. 3B is a graph illustrating simulated and measured normalized radiation pattern in the H-plane at 2.44 GHz for the fabricated prototype of the first exemplary embodiment of the antenna apparatus.

As shown in FIG. 2A, the simulated $S_{11}$ is below −14 decibel ("dB") in the band from 2.38 to 2.48 GHz. The axial ratio is below 3 dB from 2.4 to 2.465 GHz as shown in FIG. 2B. The prototype of the first exemplary embodiment of the antenna apparatus also has a flat peak gain between 4.5 and about 5 decibels relative to isotropic ("dBi") in the targeted band with a frequency dependent profile resembling that of a band pass filter as may be seen from FIG. 2C. The prototype of the first exemplary embodiment of the antenna apparatus also has a radiation pattern with its peak pointing in the forward direction F and a 3 dB beam width of around 90°, which covers a large angular range as shown in FIGS. 3A and 3B.

Referring to FIGS. 4A through 4E, the prototype of the first exemplary embodiment was also simulated for being placed on different parts of a human body to assess the performance the antenna apparatus may have when positioned on different parts of a human body. For instance, simulations for positioning the prototype of the first exemplary embodiment of the antenna apparatus 9 on a chest or shoulder of a human body were carried out. The first exemplary embodiment of the antenna apparatus as well as other embodiments could also be configured for positioning on other parts of a human or other animal or on an article of clothing that could be worn by a user (e.g. on a wrist band, a necklace, a bracelet, an ID badge, a clip, an arm band, a shirt, shorts, a belt, a shoe, a hat, an earring, or other article).

Figure 4A:
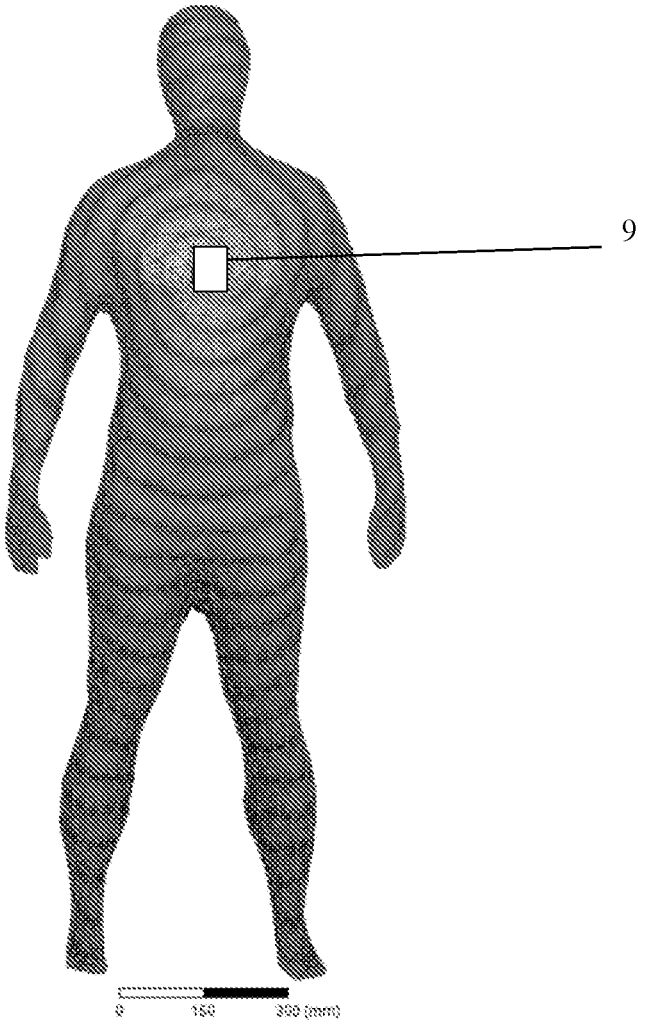
FIG. 4A is a schematic illustration of the first exemplary embodiment of the antenna apparatus being worn by a user on the user's chest.
Figure 4B:
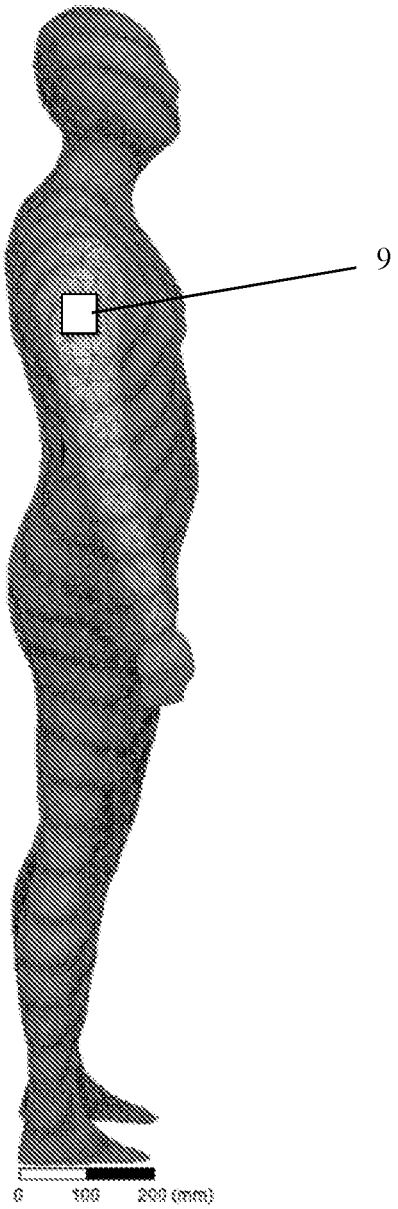
FIG. 4B is a schematic illustration of the first exemplary embodiment of the antenna apparatus being worn by a user on the user's shoulder.
Figure 4C:
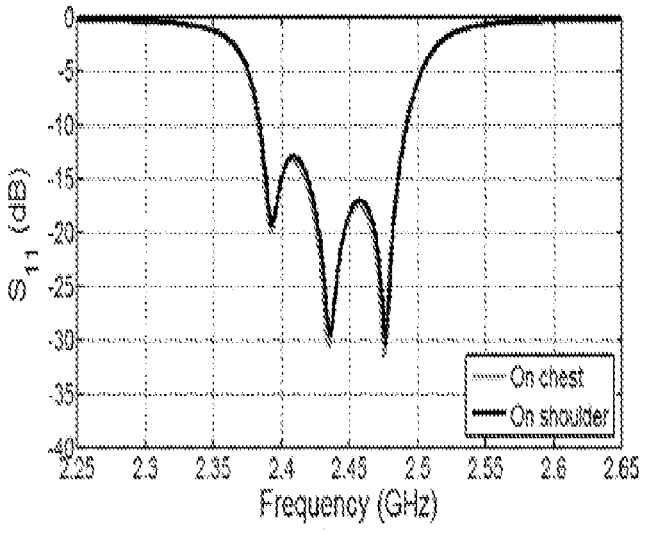
FIG. 4C is a graph illustrating simulated $S_{11}$ of the fabricated prototype of the first exemplary embodiment of the antenna apparatus when worn on the user's shoulder and when worn on the user's chest.
Figure 4D:
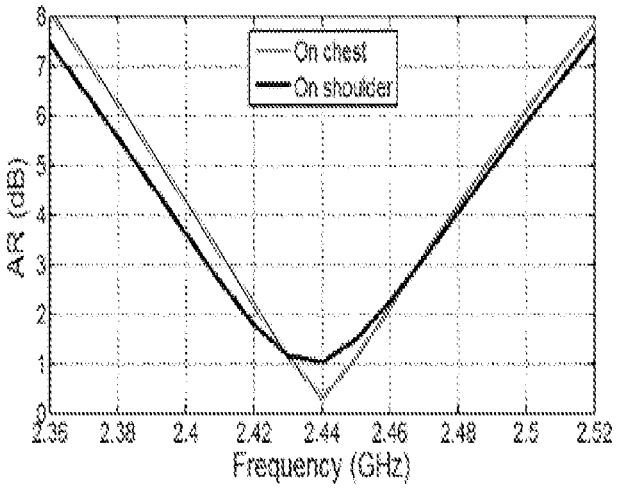
FIG. 4D is a graph illustrating simulated axial ratio of the fabricated prototype of the first exemplary embodiment of the antenna apparatus when worn on the user's shoulder and when worn on the user's chest.
Figure 4E:
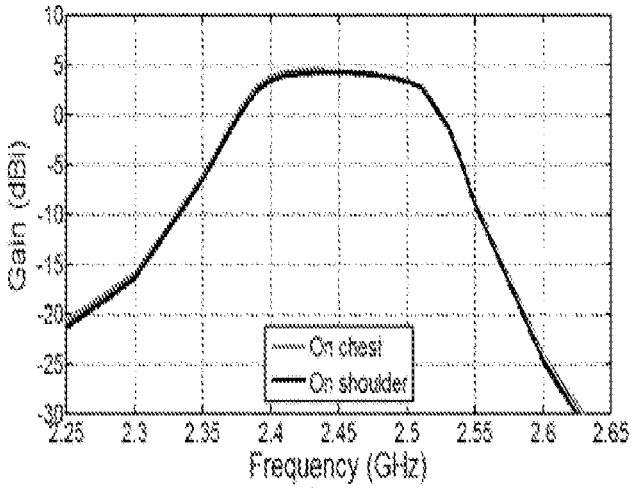
FIG. 4E is a graph illustrating simulated gain of the fabricated prototype of the first exemplary embodiment of the antenna apparatus when worn on the user's shoulder and when worn on the user's chest.

For the simulation results shown in FIGS. 4C-4E, a permittivity value equal to ⅔ of that of muscle was assigned to a homogenous human body model. In addition to radiation into free space away from the human body for off-body communications, surface waves can be found on the human body that can potentially be used to support on body mode of communication. The prototype of the first exemplary embodiment of the antenna apparatus was found to exhibit a very robust performance when placed in close proximity to human tissue resulting $S_{11}$, axial ratio, and gain values that remain nearly unchanged as shown in FIGS. 4C-4E.

Figure 5A:
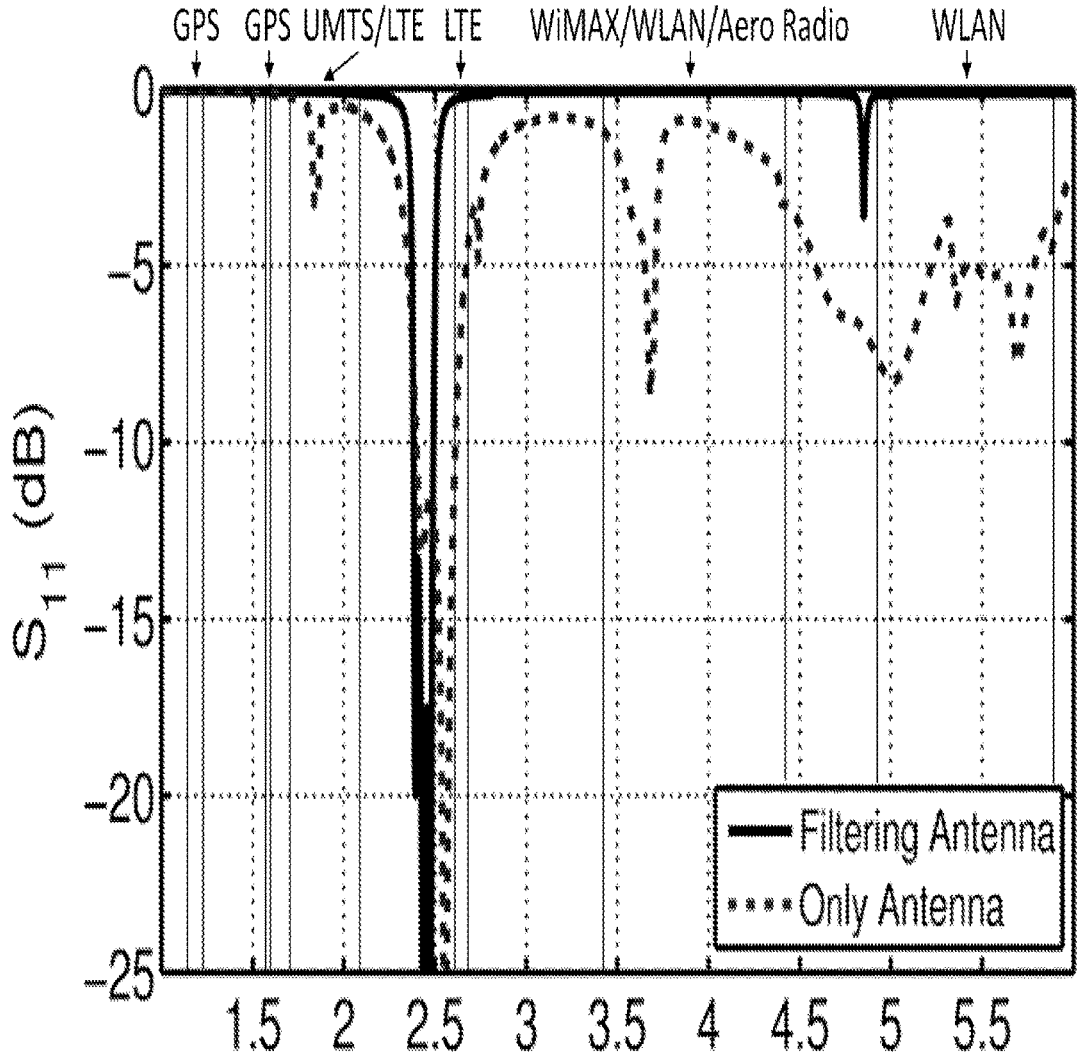
FIG. 5A is a graph illustrating simulated $S_{11}$ of a circularly polarized ("CP") patch antenna that does not include a band pass filter (labeled as only antenna) as well as a CP patch antenna that is connected to a band pass filter (labeled as filtering antenna).
Figure 5B:
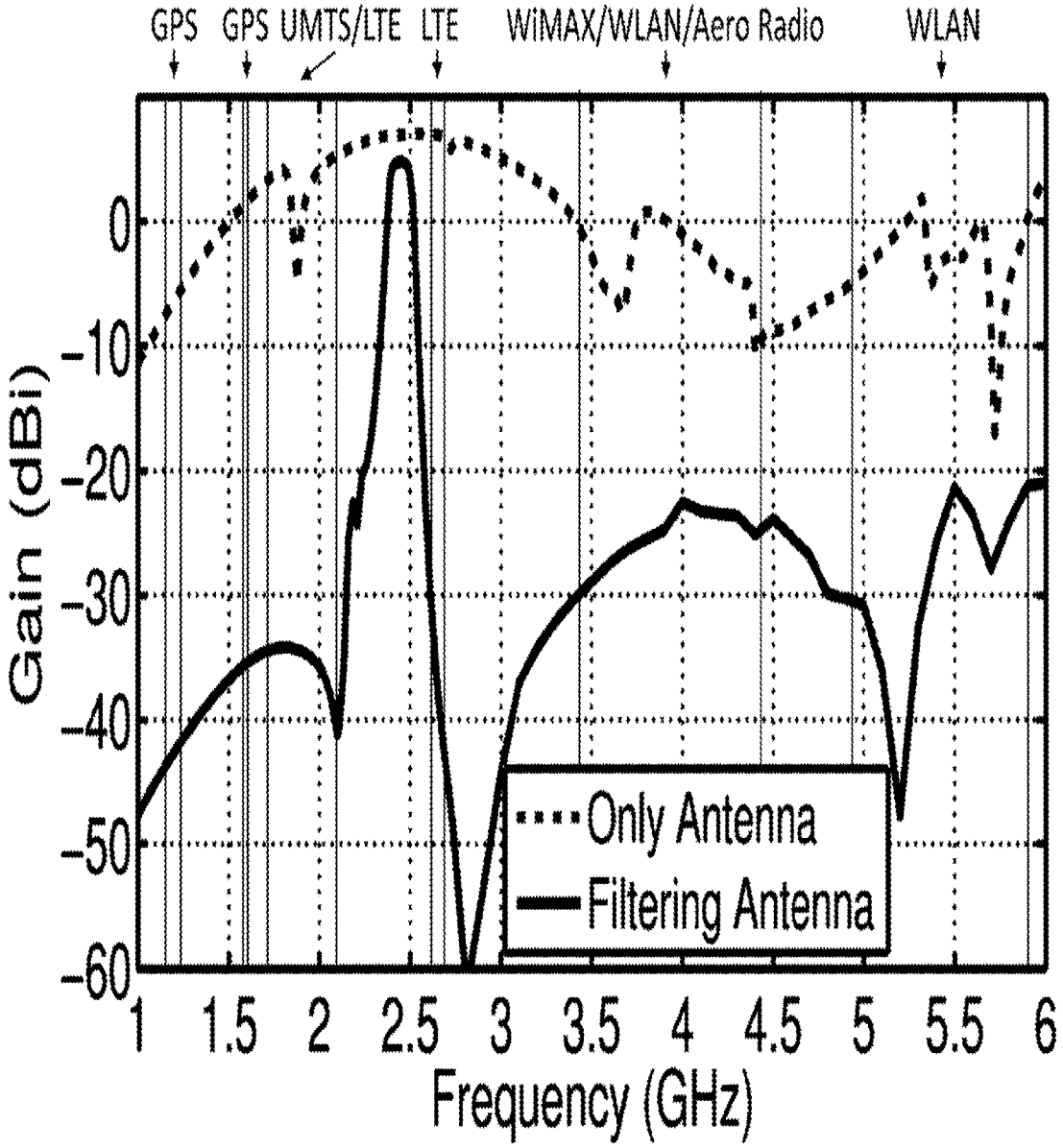
FIG. 5B is a graph illustrating simulated gain of the CP patch antenna that does not include a band pass filter (labeled as only antenna) as well as a CP patch antenna that is connected to a band pass filter (labeled as filtering antenna).

Simulations were also performed to validate that embodiments of the first exemplary antenna apparatus would provide a superior performance to other types of antenna designs. FIGS. 5A through 5B illustrate results of the conducted simulations for different CP patch antenna designs configured for operation in the 2.4-2.6 GHz band that do not include the stripline element that is configured to provide filtering as used in the first exemplary embodiment of the antenna. In FIGS. 5A and 5B, simulation results for a CP patch antenna that does not include a filter and is not connected to a filter (results labeled as "Only Antenna" in FIGS. 5A and 5B) as well as a CP patch antenna that is attached to a band pass filter (results labeled as "Filtering Antenna" in FIGS. 5A-5B) show that the first exemplary embodiment of the antenna apparatus would provide superior results to these CP antenna designs. For instance, in the 1-6 GHz range, the CP patch antenna that does not include any filter has a wide S11 value that is less than −10 dB around the 2.4-2.6 GHz band with a small reflection and also has other narrow and wide spurious bands in the 1.8, 3.7, and 4.5-5.9 GHz regions. It also has a profile that is well above −10 dBi in gain throughout almost the entirety of the 1-6 GHz range. The poor selectivity of both the S11 and gain shows that the CP patch antenna would be subject to interference and cross talk caused by other existing wireless systems such as various global positioning system ("GPS") bands (e.g. the 1-2 GHz GPS band), the 1.7-1.9 GHz Global System for Mobile Communications ("GSM:) band, the 1.7-2.1 GHz Universal Mobile Telecommunications System ("UMTS") band, the 2.1 and 2.6 GHz Long-Term Evolution ("LTE") bands, the 3.6-3.7 GHz and 4.9-5.8 GHz wireless local area network ("WLAN") bands, the 4.2-4.4 GHz aeronautical radio band ("Aero Radio"), and the 3.4-3.6 Worldwide Interoperability for Microwave Access ("Wi-Max") band (each band identified within FIGS. 5A and 5B).

Figure 6:
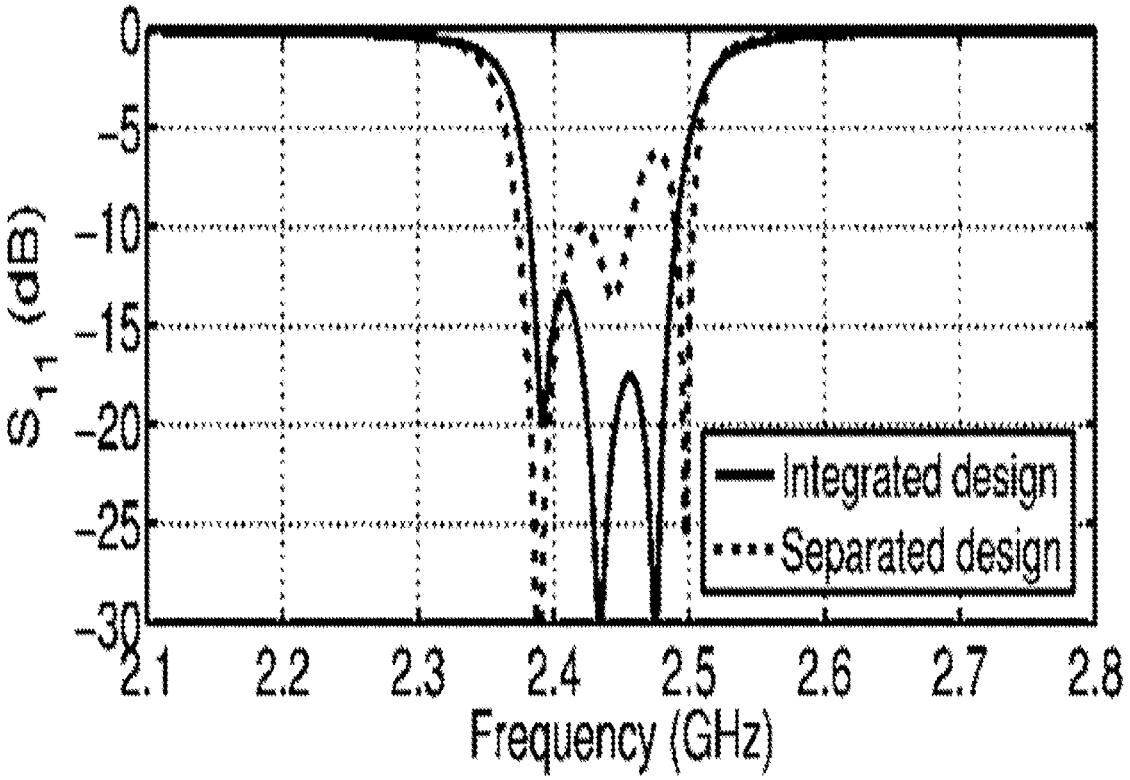
FIG. 6 is a graph illustrating simulated $S_{11}$ of the fabricated prototype of the first exemplary embodiment of the antenna apparatus as well as simulated $S_{11}$ of a CP patch antenna that is attached to a band pass filter, which are both configured to achieve the best matching to 50Ω.
Figure 7A:
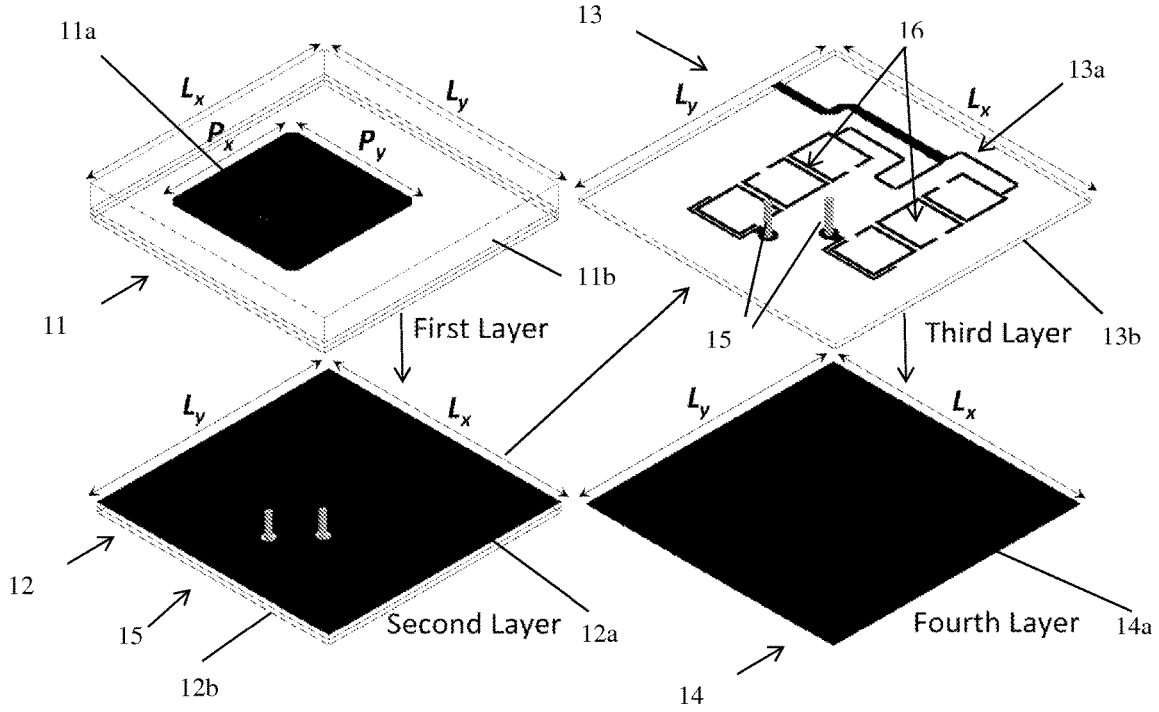
FIG. 7A is an exploded view of a second exemplary embodiment of the antenna apparatus in which black colored portions represent printed metal layers while white color portions represent dielectric substrates. Elements 15 represent metallic vias.
Figure 7B:
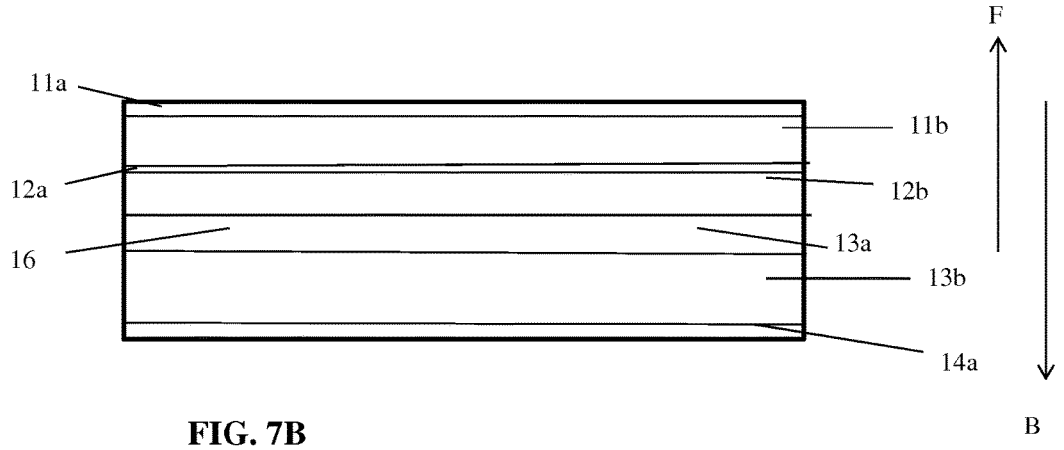
FIG. 7B is a side view of the second exemplary embodiment of the antenna apparatus.

FIG. 6 compares the prototype of the first exemplary embodiment of the antenna apparatus to the CP antenna that is attached to a band pass filter. The CP antenna and band pass filter to which it is attached evaluated in FIG. 6 were both designed separately to match to 50Ω. As can be seen from FIG. 6, the CP patch antenna with the separately attached band pass filter has a slightly broader pass band along with a much higher $S_{11}$ than the prototype of the first exemplary embodiment of the antenna apparatus. For instance, in the 2.45-2.49 GHz range, the S11 of the CP patch attached to the band pass filter is above −10 dB. The comparison of FIG. 6 shows that the integration of a band pass filter and antenna of the first exemplary embodiment of the antenna apparatus provides substantial advantages over a CP patch that is attached to a separate band pass filter.

Referring to FIGS. 7A-10B, a second exemplary embodiment of our antenna apparatus 19 can include a plurality of layers such as a first layer 11, a second layer 12, a third layer 13 and a fourth layer 14. The first layer can include a first metallic layer 11*a* and a first dielectric layer 11*b*. The second layer 12 can include a second metallic layer 2*a* and a second dielectric layer 12*b* as well as multiple vias that extend from the second metallic layer 12*a* to the first metallic layer 11*a*. The second dielectric layer 12*b* may be bonded or otherwise attached to the first and second metallic layers 11*a* and 12*a*. The third layer 13 can include a third metallic layer 13*a* and a third dielectric layer 13*b* and can also include multiple vias that extend from the third metallic layer 13*a* to the second metallic layer 12*a*. The third dielectric layer 13*b* can be bonded or otherwise attached to the third metallic layer 13*a*. The fourth layer 14 can include a fourth metallic layer 14*a* that is bonded or is otherwise attached to the third dielectric layer 13*b*. The first dielectric layer 11*b* can be positioned between the first and second metallic layers 11*a* and 12*a*, the second dielectric layer 12*b* can be positioned between the second and third metallic layers 12*a* and 13*a*, and the third dielectric layer can be positioned between the third and fourth metallic layers 13*a* and 14*a*. The second exemplary embodiment of the antenna apparatus can be configured to operate over a wide bandwidth.

It should be appreciated that the metal of the first, second, third, and fourth metallic layers 11*a*, 12*a*, 13*a*, and 14*a* can be a conductive material. The metal compositions for each of these metallic layers may be unique to that layer or may be the same type of metal as in at least one other metallic layer. In yet other embodiments, all of the metallic layers may be composed of the same type of metal.

In some alternative embodiments, at least one of the metallic layers, such as at least one of the first upper metallic layer 11*a*, second metallic layer 12*a*, third metallic layer 13*a*, and fourth metallic layer 14*a*, can be composed of a non-metal type of conductive material such as graphene or a conductive polymeric material. In yet other alternative embodiments, all of these metallic layers may be composed of the same non-metal type of conductive material or other type of conductive material.

The upper first layer 11 can be configured as a top patch antenna or other type of signal receiving and transmitting element that is fed by two pins and two stripline band pass filters. The two striplines (e.g. first and second striplines) can each be defined by a transmission medium 16 that is positioned between a metal sheet of the second metallic layer 12*a* and a metal sheet of the fourth metallic layer 14*a*. Each transmission medium 16 can be configured as a coupled resonator microwave band pass filter where there is a 90° phase difference between each of the two transmission medium coupled-resonator band pass filters 16 of the third layer 13.

The feeding vias 15 can be configured as pins or other type of via element. The vias 15 can be located on the symmetry lines of the patch antenna of the first layer 11 in both the x and y directions (e.g. length and width directions) in order to obtain two linearly-polarized modes. The 90° phase shift along with the filtering circuit of the third layer 13 can provide a circular polarization and impedance match only in a pre-selected targeted band.

The second metallic layer 12*a* can be a metal sheet that is configured to function as a top ground plane of the striplines defined by the second, third and fourth layers 12, 13, and 14 and also the ground plane of the antenna defined in the first layer 11. The fourth metallic layer 14*a* can be a metal sheet attached to the third layer 13 that provides a bottom ground plane to the striplines defined by the second, third and fourth layers 12, 13, and 14. The structures of striplines can be configured to provide blockage for reducing backward radiation (e.g. radiation directed away from the top first layer 11 towards (and beyond) the bottom fourth layer 14 in the F direction). The striplines can be configured so that the striplines function as a last resonating state of a filter so that the stripline structures not only perform filtering but also provide a reactive matching network that greatly enhances the impedance bandwidth of the antenna.

The transmission mediums 16 of the striplines can each be a layer of the antenna apparatus or be included in a layer of the antenna apparatus. The transmission mediums can each be a circuit that includes resonators, a phase shifter, and a metal transmission medium that is entirely within insulating material of a substrate that defines the third layer 13 so that portions of the substrate are positioned between the transmission medium and the second and fourth layers 12 and 14 to space the transmission mediums 16 away from the second and fourth layers 12 and 14. The insulating material of the substrate of the third layer can form a dielectric. The width, thickness, and relative permittivity of the substrate can help define the characteristic impedance of the transmission mediums 16. Vias can connect the second and fourth layers 12, 14 together in some embodiments of the antenna apparatus to short the upper ground plane of the striplines (e.g. second layer 12) the bottom ground plane of the striplines (e.g. fourth layer 14).

The second exemplary embodiment of the antenna apparatus can be configured so that a pass band and circularly-polarized wave in a pre-selected band can be achieved with a low profile of less than $0.07\lambda_0$. The resonators connected to and/or included in the transmission mediums 16 of the striplines can be open loop filters or may be other types of planar microwave resonators. Other types of power dividers and 90° phase shifters can also be employed in embodiments of the antenna apparatus to provide the reactive matching while also providing a desired filtering.

FIGS. 8A through 10E illustrate testing and simulation results for a particular sized version of the second exemplary embodiment that was designed to operate in the 3.75-4.25 GHz band. Other embodiments could be configured to operate in other pre-selected ranges. The dimensions of the embodiment of the antenna apparatus were determined by time domain tuning and subsequent optimization via a CMA-ES process. The prototype of the second exemplary embodiment of the antenna apparatus 19 was fabricated to have a form factor of 40 mm by 40 mm by 5 mm, i.e. $0.53\lambda_0$ by $0.53\lambda_0$ by $0.067\lambda_0$. The metal for the metallic layers used in this prototype was copper.

Figure 8A:
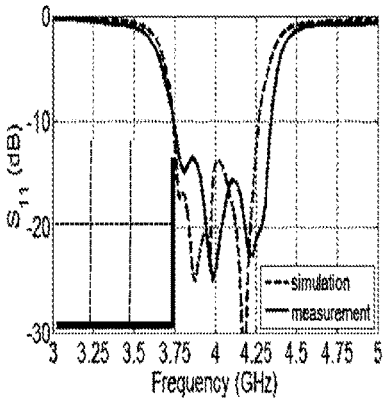
FIG. 8A is a graph illustrating simulated and measured $S_{11}$ results for a fabricated prototype of the second exemplary embodiment of the antenna apparatus.
Figure 8B:
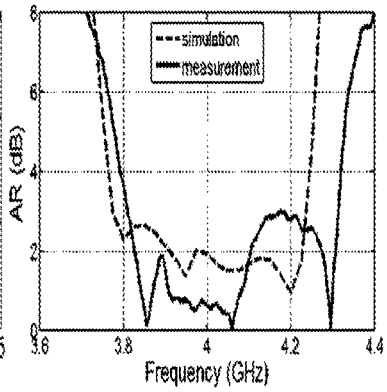
FIG. 8B is a graph illustrating simulated and measured results for axial ratio for the fabricated prototype of the second exemplary embodiment of the antenna apparatus.
Figure 8C:
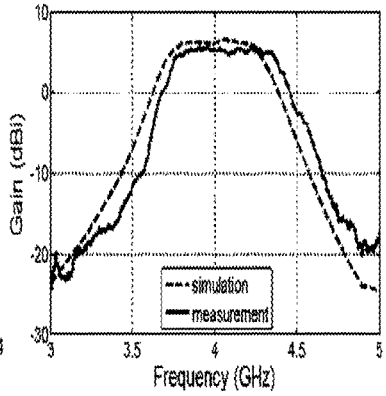
FIG. 8C is a graph illustrating simulated and measured antenna gain for the fabricated prototype of the second exemplary embodiment of the antenna apparatus.
Figure 9A:
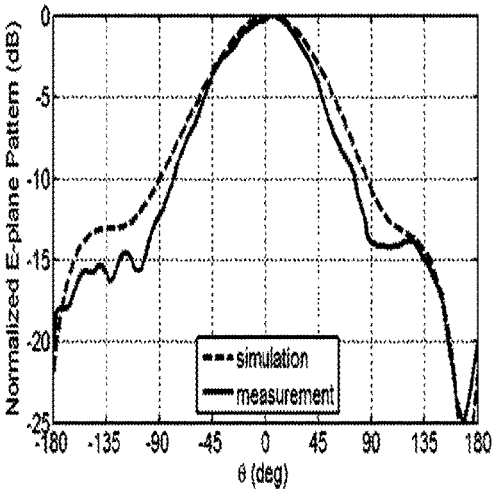
FIG. 9A is a graph illustrating simulated and measured normalized radiation patterns in the E-plane at 4 GHz for the fabricated prototype of the second exemplary embodiment of the antenna apparatus.
Figure 9B:
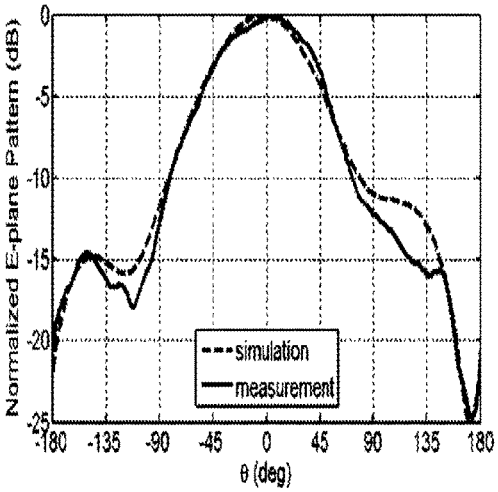
FIG. 9B is a graph illustrating simulated and measured normalized radiation pattern in the H-plane at 4 GHz for the fabricated prototype of the second exemplary embodiment of the antenna apparatus.
Figure 10A:
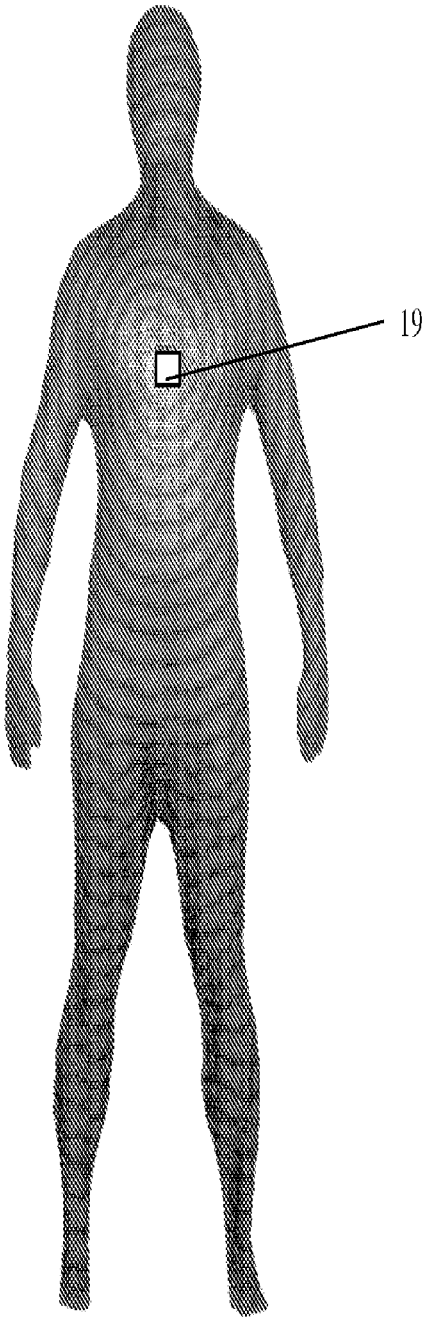
FIG. 10A is a schematic illustration of the second exemplary embodiment of the antenna apparatus being worn by a user on the user's chest.
Figure 10B:
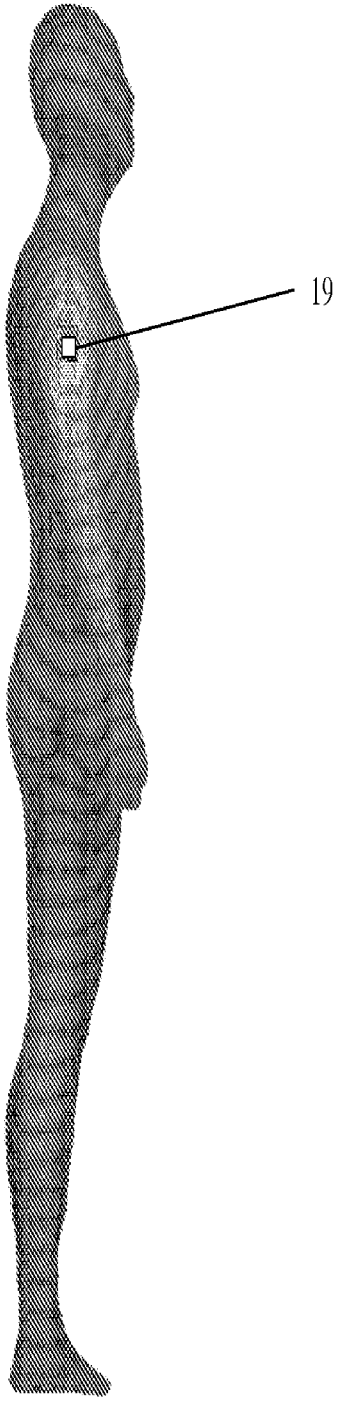
FIG. 10B is a schematic illustration of the second exemplary embodiment of the antenna apparatus being worn by a user on the user's shoulder.
Figure 10C:
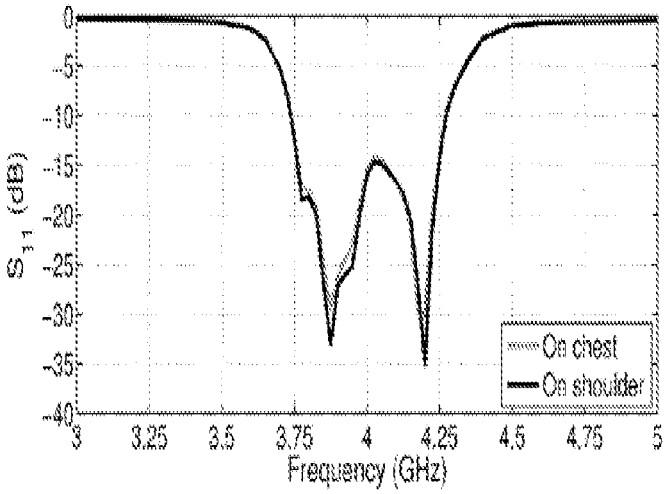
FIG. 10C is a graph illustrating simulated $S_{11}$ of the fabricated prototype of the second exemplary embodiment of the antenna apparatus when worn on the user's shoulder and when worn on the user's chest.
Figure 10D:
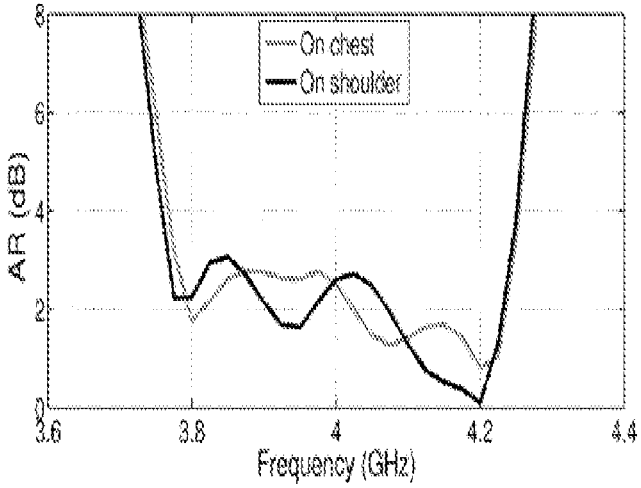
FIG. 10D is a graph illustrating simulated axial ratio of the fabricated prototype of the second exemplary embodiment of the antenna apparatus when worn on the user's shoulder and when worn on the user's chest.
Figure 10E:
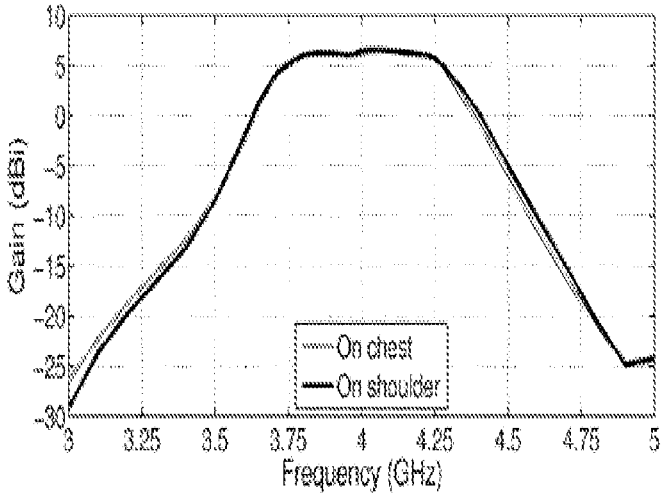
FIG. 10E is a graph illustrating simulated gain of the fabricated prototype of the second exemplary embodiment of the antenna apparatus when worn on the user's shoulder and when worn on the user's chest.

As can be seen from the simulation and measurement results shown in FIGS. 8A-8C, the fabricated version of the second exemplary embodiment had a simulated $S_{11}$ that was below −12 dB for the 3.75-4.25 GHz band range. The axial ratio was below 3 dB from 3.77 to 4.23 GHz as shown in FIG. 8B and the prototype of the second exemplary embodiment of the antenna apparatus had a flat peak gain of more than 6 dBi in the 3.74-4.25 GHz band range with a frequency-dependent profile resembling that of a band pass filter. The prototype of the second exemplary embodiment of the antenna apparatus also had a radiation pattern with its peak pointing in the broadside direction and a 3 dB beam width of around 90°, which covered a large angular range as may be appreciated from FIGS. 9A-9B.

As can be appreciated from FIGS. 10A-10E, simulations for the fabricated prototype of the second exemplary embodiment of the antenna apparatus 19 was also performed to assess characteristics of the embodiment of the antenna apparatus when worn on a human chest and when worn on a human shoulder. A permittivity value equal to ⅔ of that of muscle was assigned to the homogenous human body model. In addition to radiation into free space away from the human body for off-body communications, surface waves can be found on the human body, which can potentially be used to support an on-body mode of communication. The antenna apparatus and the microwave filtering circuit of the prototype of the second exemplary embodiment of the antenna apparatus was determined to exhibit a very robust performance when they are placed in close proximity to human tissue, resulting in $S_{11}$, axial ratio, and gain values which remain nearly unchanged.

Figure 11:
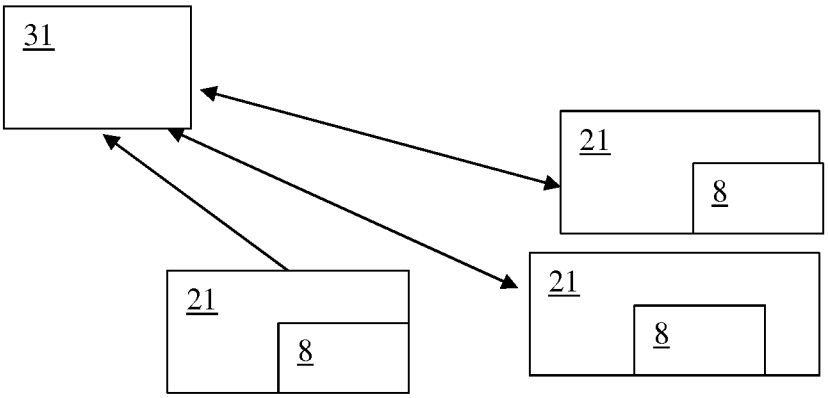
FIG. 11 is a block diagram of a first exemplary embodiment of a communication system that includes devices utilizing embodiments of our antenna apparatus.

Referring to FIG. 11, a communication system can include a computer device 31 that may be a base station, a work station, laptop computer, or other type of computer device that is configured to wirelessly communication to a plurality of electronic devices 21 that each includes an embodiment of our antenna apparatus 8 having a patch antenna attached to at least one stripline. The antenna apparatus 8 can be configured as the first or second exemplary embodiment of our antenna discussed herein or may be another embodiment of the antenna apparatus that is configured to receive and transmit signals or other data at a different pre-selected band. Each electronic device 21 may be a medical device or measurement device, or communication terminal device (e.g. a heart rate sensor, a smart phone, a communication terminal, an electronic tablet, a measurement sensor, a health condition detector, or other type of electronic device). Each electronic device may include a processor that is communicatively connected to non-transitory memory and a transceiver unit that includes the antenna apparatus 8. The computer device 31 can also include hardware that comprises a processor, non-transitory memory, and at least one wireless transceiver unit that is configured to send and receive data along the pre-selected band range for transmitting data or signals to the antenna apparatuses 8 of the electronic devices 21 to communicate information between the computer device 31 and one or more of the electronic devices 21.

It should be appreciated that variations may be made to the embodiments of our antenna apparatus discussed herein to meet a particular set of design criteria. For instance, the configuration of the antenna apparatus can be adjusted to utilize one or more stripline elements (e.g. microstrips to be fully within a substrate to be sandwiched between upper and lower ground plane elements, types of transverse electromagnetic transmission line mediums, etc.) configured to permit the antenna to receive and transmit data along only one band of a pre-selected range. As another example, the pre-selected band range can be any of a number of different suitable ranges to meet a particular set of design criteria. As another example, the types of vias and number of vias utilized in the first and third layers of the antenna apparatus can be any number of vias or combination of vias that are utilizable to meet a particular design objective (e.g. only one pin or other via on the second layer and two or more pins or other via on the third layer, only two pins on the second layer and two or more pins on the third layer, more than two vias on the second layer and more than two vias on the third layer, etc.) As yet another example, embodiments of the antenna apparatus can utilize different types of resonators or resonator elements and different types of substrates for the third layer for each stripline to provide a filtration feature and/or an impedance matching feature that meets a particular set of design criteria. The material of the second and third dielectric layers 12*b* and 13*b* may also be any material that may be suitable for the stripline(s) defined by the second, third, and fourth layers and transmission medium within the third layer to meet a particular set of design criteria. As yet another example, the size, thickness, and shape of each metallic layer and each dielectric layer and the material composition of those layers can be any of a number of different suitable compositions. For instance, each metallic layer can be composed of a metal or may alternatively be a conductive material layer that is composed of any type of conductive material (e.g. metal, graphene, conductive polymeric material, etc.). Each dielectric substrate layer can be composed of any type of dielectric material that may meet a particular set of design criteria. As yet another example, each transmission medium may be structured as a microstrip, a transmission line, or may be composed of any type of structure or element configured to transmit and/or receive a signal for the communication of data. As yet another example, embodiments of a processor of the computer device 31 or electronic device 21 can include a microprocessor, central processing unit, or other type of hardware processor and embodiments of the non-transitory memory of the electronic device 21 or computer device 31 can include a hard drive, flash memory, or other type of non-transitory memory that can store computer readable media such as applications, electronic data, or code defining software or a computer program. Therefore, while certain present preferred embodiments of our antenna apparatus and communication systems, and embodiments of methods for making and using the same have been shown and described above, it is to be distinctly understood that the invention is not limited thereto but may be otherwise variously embodied and practiced within the scope of the following claims.

We claim:

1. An antenna apparatus comprising:

a first layer having an antenna and a first stripline attached to the first layer;

the first stripline being comprised of a second layer, a third layer, and a fourth layer, the third layer being positioned between the second and fourth layers, a transmission medium being within the third layer, resonators being connected to the transmission medium such that only a signal within a pre-selected band is passable through the transmission medium and any band outside of the pre-selected band is stopped by the resonators such that the signal is not passable through the transmission medium; and a second stripline, a phase shifter connecting the first stripline to the second stripline.

2. An antenna apparatus comprising:

a first layer having an antenna and a first stripline attached to the first layer;

the first stripline being comprised of a second layer, a third layer, and a fourth layer, the third layer being positioned between the second and fourth layers, a transmission medium being within the third layer, resonators being connected to the transmission medium such that only a signal within a pre-selected band is passable through the transmission medium and any band outside of the pre-selected band is stopped by the resonators such that the signal is not passable through the transmission medium; and wherein the first layer is comprised of a first conductive material layer that is positioned above a first dielectric substrate layer, wherein the second layer is comprised of a second conductive material layer and a second dielectric substrate layer, the second conductive material layer being positioned between the first and second dielectric substrate layers, the third layer is comprised of a third conductive material layer and a third dielectric substrate layer, the third conductive material layer being positioned between the second and third dielectric substrate layers, and the fourth layer is comprised of a fourth conductive material layer;

at least one first via extending from the first conductive material layer to the second conductive material layer and at least one second via extending from the second conductive material layer to the third conductive material layer; and wherein the second conductive material layer is configured as an upper ground plane and the fourth conductive material layer is configured as a lower ground plane; and wherein the first conductive material layer is configured as the antenna and is conductively connected to the transmission medium of the first stripline by at least the first and second vias.

3. A communication system comprising at least one electronic device having the antenna apparatus of claim 2.

4. The antenna apparatus of claim 2, wherein the first stripline is comprised of a circuit having the resonators.

5. The antenna apparatus of claim 2, wherein the antenna is a planar patch antenna or a patch antenna.

6. The antenna apparatus of claim 2, wherein the resonators are within the third layer.

7. An antenna apparatus comprising:

a first layer having an antenna and a first stripline attached to the first layer;

the first stripline being comprised of a second layer, a third layer, and a fourth layer, the third layer being positioned between the second and fourth layers, a transmission medium being within the third layer, resonators being connected to the transmission medium such that only a signal within a pre-selected band is passable through the transmission medium and any band outside of the pre-selected band is stopped by the resonators such that the signal is not passable through the transmission medium; and wherein the resonators are within the third layer and the resonators and the transmission medium at least partially define a circuit in the third layer.

8. The antenna apparatus of claim 7, wherein the first stripline is configured so that an output impedance of the first stripline is complex conjugate with an input impedance of the antenna.

9. The antenna apparatus of claim 7, wherein the first stripline is configured so that an output impedance of the first stripline is about complex conjugate with an input impedance of the antenna.

10. The antenna apparatus of claim 7, wherein the first stripline is also configured to block backward radiation being emitted from the antenna.

11. The antenna apparatus of claim 7, wherein the pre-selected band is 2.4-2.48 GHz, 2.4-2.49 GHz, 4.9-5.8 GHz, or is 3.75-4.25 GHz.

12. The antenna apparatus of claim 7, wherein the first layer is a top layer that is comprised of a substrate and the antenna is a patch antenna that is connected to the substrate of the first layer; and wherein the fourth layer is below the first layer, is below the second layer, and is below third layer.

13. The antenna apparatus of claim 7, wherein a radiation pattern of the antenna has a peak that points in a broadside direction.

14. The antenna apparatus of claim 7, wherein the resonators are configured to define stop bands to prevent transmission of a signal that the antenna transmits to the first stripline that is outside of the pre-selected band range.

15. The antenna apparatus of claim 7, wherein the resonators comprise at least one of a plurality of open loop resonators, a plurality of planar microwave resonators, and a plurality of microwave resonators.

16. The antenna apparatus of claim 7, wherein the first layer is comprised of a first conductive material layer that is positioned above a first dielectric substrate layer, wherein the second layer is comprised of a second conductive material layer and a second dielectric substrate layer, the second conductive material layer being positioned between the first and second dielectric substrate layers, the third layer is comprised of a third conductive material layer and a third dielectric substrate layer, the third conductive material layer being positioned between the second and third dielectric substrate layers, and the fourth layer is comprised of a fourth conductive material layer.

17. The antenna apparatus of claim 16, wherein each of the first conductive material layer, the second conductive material layer, the third conductive material layer, and the fourth conductive material layer is comprised of metal and each of the first dielectric substrate layer, second dielectric substrate layer, and third dielectric substrate layer is comprised of an insulating material.

18. The antenna apparatus of claim 7, comprising vias connected to the circuit.

19. A communication system comprising at least one electronic device having the antenna apparatus of claim 7.

* * * * *